US006564962B1

(12) United States Patent
Cheng

(10) Patent No.: US 6,564,962 B1
(45) Date of Patent: May 20, 2003

(54) RENOVATED STRUCTURE OF BOWL WITH FUNCTION OF ROTATING AND CHANGEABLE PATTERNS

(76) Inventor: I Fen Cheng, 3F, No.157-3, Chiu Kang Street, Mucha,Taipei (TW)

( * ) Notice: Subject to any disclaimer, the term of this patent is extended or adjusted under 35 U.S.C. 154(b) by 0 days.

(21) Appl. No.: 10/083,122

(22) Filed: Feb. 27, 2002

(51) Int. Cl.[7] ..... A47G 19/00; A47G 21/00
(52) U.S. Cl. ..... 220/574; 206/459.5; 206/457
(58) Field of Search ..... 220/574; 206/459.5, 206/457, 458, 217

(56) References Cited

U.S. PATENT DOCUMENTS 5,525,383 A * 6/1996 Witkowski ..... 428/30
5,614,275 A * 3/1997 Chan ..... 428/35.7
6,073,798 A * 6/2000 Rosenhain ..... 220/736
6,398,058 B1 * 6/2002 Walsh ..... 220/485
6,398,065 B1 * 6/2002 Lewis ..... 220/737

* cited by examiner

*Primary Examiner*—Joseph M. Moy
(74) *Attorney, Agent, or Firm*—Bacon & Thomas, PLLC

(57) ABSTRACT

This invention is a "renovated structure of bowl with the function of rotating and the changeable patterns". Especially there are several selections of the patterns for the bowl. This invention is consisted by a mainframe, outer rings, patterned rings, and a base. The patterned ring is set on the outer ring, and the outer ring is fit in the mainframe from the downside, and then the base is combined with the mainframe. The outer rings may not only allow the bowl to rotate, but also provide various fascinating patterns for change. The consumers may choose their preferred patterns and colors on the bowl to create the lovely atmosphere in the kitchen.

1 Claim, 3 Drawing Sheets

RENOVATED STRUCTURE OF BOWL WITH FUNCTION OF ROTATING AND CHANGEABLE PATTERNS

BACKGROUND OF THE INVENTION

1. Field of the Invention

A colorful bowl with various patterns creates the lovely atmosphere in the kitchen and also provides lots of fun, brainstorming game, and education.

2. Description of the Related Art

An inventor once created one kind of glass with new structure and function of rotating. The imbodiment is consisted by a mainframe, fixed base and several rings. The mainframe surrounded by the rings can rotate freely and present the different styles of the glasses.

This idea can be used on the glasses; however, it may not be used on the bowls. The main reason is clearly shown in the figure. The glass is a cylinder surrounded by several rings and therefore can freely rotate. The idea is easy to understand. There is no special and creative idea for the structure, so the idea is not suitable for bowls with arc surface.

Meanwhile, there is only some patterns painted or pasted on the glass and the patterns are not changeable, so there are still some shortcomings to be improved. It is also a pity that this idea is not suitable for the bowls.

SUMMARY OF THE INVENTION

The main purpose of this invention is to create a bowl with pleasant look for better visual effect and entertainment. It is a dish consisted by the mainframe, outer rings, patterned rings, and a base. The rings make it easily to rotate and form variety of different patterns and colors. It is much different from the traditional bowl with monotonous look.

The patterned rings can present the three-dimension patterns. Therefore, another purpose of this invention is to reach the promotion purpose and improve the visual effect so as to make the best use of the bowls.

DETAILED DESCRIPTION OF THE PREFERRED EMBODIMENT

Figure 1:
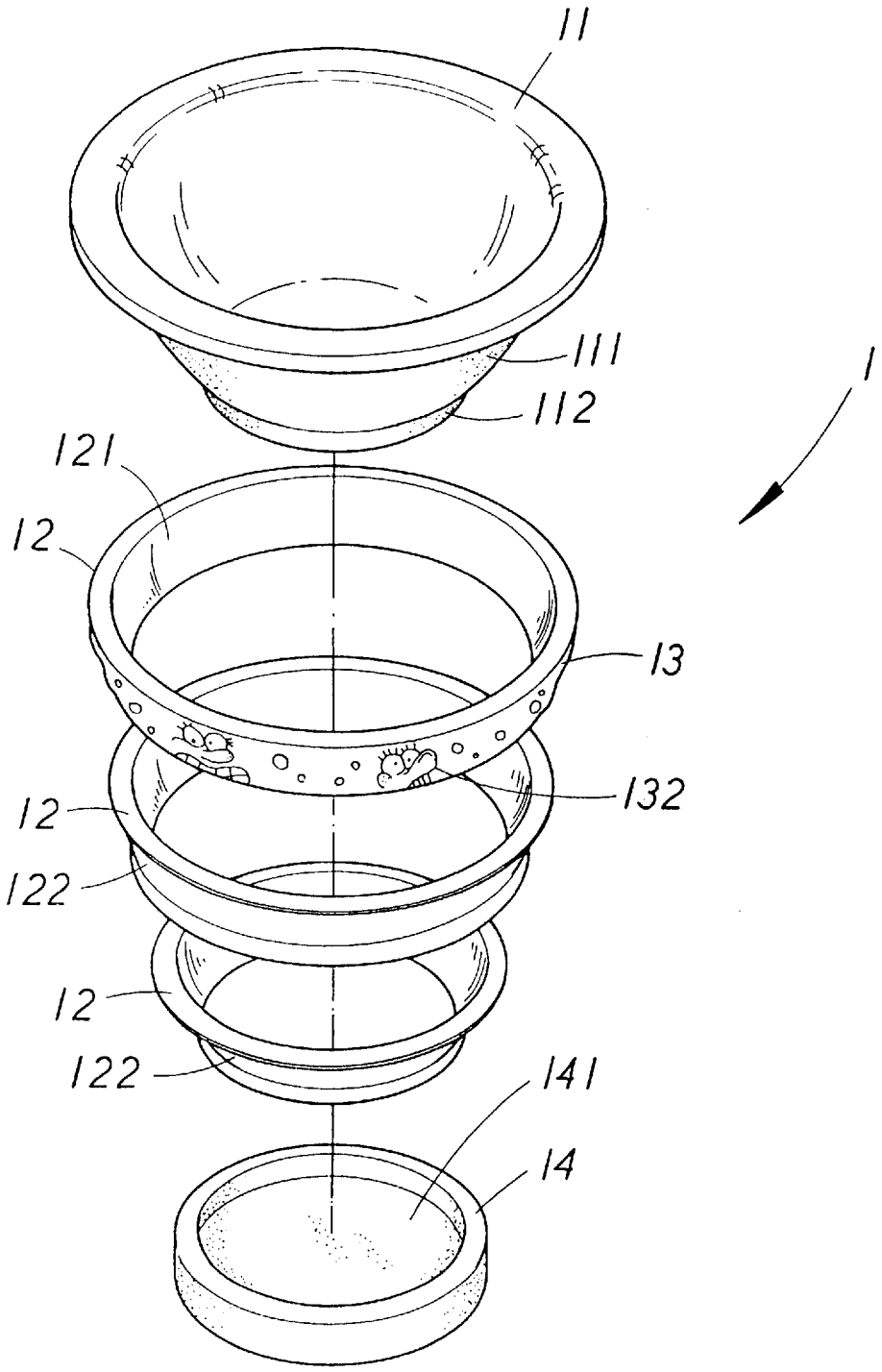
FIG. 1. Three-dimension analysis drawing of the invention

Refer to FIG. 1. The mainframe (11) is a bowl structure with an arc surface (111) and a protuberant bottom (112).

The outer ring (12) fit in the mainframe (11). Inside the ring is an arc surface (121), and the outside is a concave surface (122). The whole structure is then formed with wide top and narrow bottom.

The patterned ring (13) is made of flexible material with inside surface (131) and patterned surface (1 32). It is set on the outer ring (12).

The base (14) is concave (141) so can combined with the mainframe (11).

As described above, the whole embodiment has wide top and narrow bottom. The mainframe (11) has 3 arc surfaces

(111). Because the outer ring (12) has wide top and narrow bottom, it must be fit in the mainframe from the downside. The patterned ring (13) is set on the concave surface (122) of outer ring (12), and then the three outer rings (12) are fit in the mainframe (11). Combine the concave base (14) together with the mainframe with protuberant bottom (112), and then the shape of bowl (1) is finished.

Figure 2:
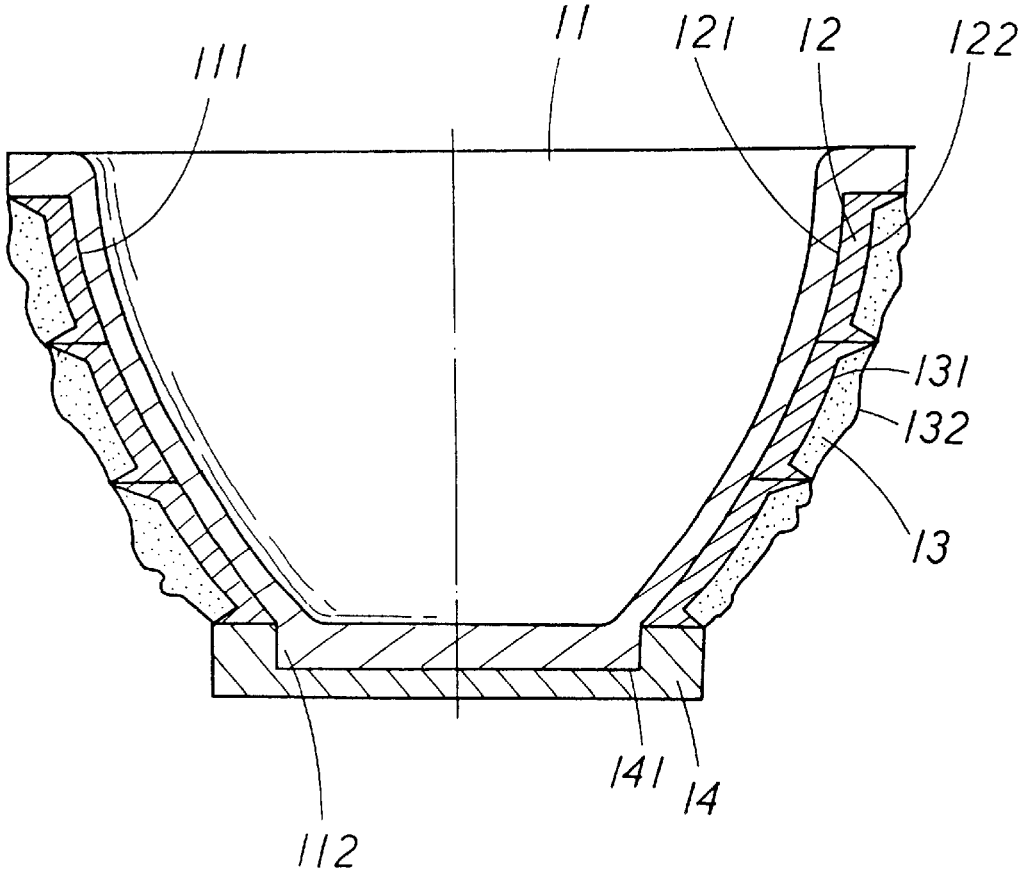
FIG. 2. Drawing of embodiment analysis

Due to the bowl (1) has arc surface; the outer ring (12) must have wide top and narrow bottom. Besides, the outer rings (12) are not the same sizes. After setting the patterned ring (13) on the outer rings (12), fit the bigness outer ring (12) on the bowl first, and then the bigger one and small one. By doing this, the pattern (132) on the patterned ring (13) is presented from the top to the bottom surface of the bowl. Because the outer ring (12) has arc surface (121), it may rotate on the arc surface (111) freely to reach the expected effect show in FIG. 2. The bowl then may present pleasant patterns.

Figure 3:
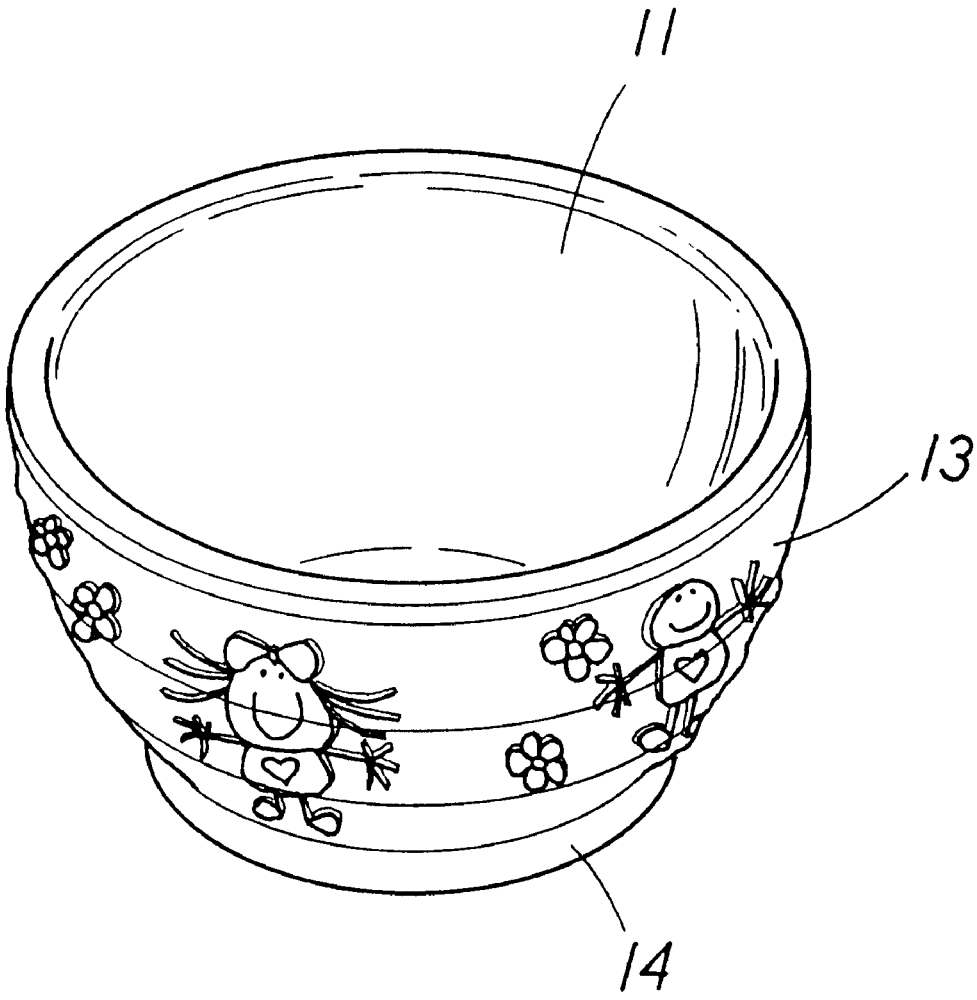
FIG. 3. Three-dimension drawing of the invention

Meanwhile, the concave surfaces (122) of outer rings (12) of this invention are created to set in the patterned rings (13). The patterned rings (13) are made of flexible rubber material, so the pleasant patterns may create the unique three-dimension visual effect (132). Refer to FIG. 3; what is more important is that the traditional bowls only have flat and unchangeable patterns on them. However, the patterned ring of this invention may offer several selections of patterns and colors to stimulate consumers' desire of purchase. The fascinating look of the bowl may also create the lovely atmosphere in the kitchen.

In conclusion, this invention of bowl may not only have the function of rotating but also changeable pleasant patterns. Comparing with the traditional bowls, this invention is much better, and there was no invention with similar structure in the market before. This invention has met the requirement of patent, and we therefore apply for the patent in accordance with the law. Your careful audition and approval of this application of patent will be much appreciated.

The specification above is however the best examples of this invention and shall not be the limit range of this invention. The modification and correction made in accordance with the applied patent of this invention shall be included in the patent of this invention.

What is claimed is:

1. A renovated structure of a bowl with the function of rotatable and changeable patterns, comprising: a mainframe in said bowl with a wide top and narrow bottom arc surface and a protuberant bottom;

a plurality of rotatable outer rings fitting said mainframe, each outer ring including an arc surface at an inside surface and concave surface at an outer surface, said outer rings being wide at top portion and narrow at bottom portion;

a plurality of flexible, rubber-like material rings having three dimensional pattern, setting at the outer surface of said outer rings;

a base having a concave surface connecting to said mainframe;

whereby when said outer rings with said pattern rings connecting to said mainframe from a downside of said mainframe, and said base connecting to said protuberant bottom, said bowl being assembled.

* * * * *